United States Patent [19]

Brown

[11] 4,086,722

[45] May 2, 1978

[54] SPINABLE OBJECT ON A LENGTH-ADJUSTABLE TETHER DETACHABLY SECURED TO A ROTATABLE BOBBIN

[76] Inventor: Paul L. Brown, 982 Lakeview Way, Redwood City, Calif. 94062

[21] Appl. No.: 804,615

[22] Filed: Jun. 8, 1977

[51] Int. Cl.[2] ..... A63H 27/12

[52] U.S. Cl. ..... 46/61; 46/67

[58] Field of Search ..... 46/64, 70, 71, 72, 73, 46/60, 61, 62, 63, 65, 66, 67, 47, 51

[56] References Cited

U.S. PATENT DOCUMENTS

| | | | |
|---|---|---|---|
| 2,535,157 | 12/1950 | Radovan | 46/70 |
| 3,037,321 | 6/1962 | Thomason | 46/220 |
| 3,452,470 | 7/1969 | Wohlstrom | 46/62 |
| 3,802,117 | 4/1974 | Engelhardt | 46/61 |
| 3,834,069 | 9/1974 | Brown | 46/51 |
| 3,858,348 | 1/1975 | Brown | 46/61 |

*Primary Examiner*—Louis G. Mancene
*Assistant Examiner*—Mickey Yu

[57] ABSTRACT

A spinable object of a variable weight with variable attachments depending on a length-adjustable tether at variable distances from a bobbin rotatably mounted on a handle so shaped as to prevent fouling of the tether.

5 Claims, 6 Drawing Figures

SPINABLE OBJECT ON A LENGTH-ADJUSTABLE TETHER DETACHABLY SECURED TO A ROTATABLE BOBBIN

The present invention is a further improvement upon my prior inventions in this art which are disclosed and claimed in my U.S. Pat. No. 3,834,069, issued to me on Sept. 10, 1974 and entitled HAND MANIPULATED TOY, as well as U.S. Pat. No. 3,858,348, issued to me on Jan. 7, 1975 and entitled ROTATABLE BOBBIN AND TETHERED SPINNING OBJECT, and U.S. Pat. No. 3,523,386, issued to me on Aug. 11, 1970, and entitled SPINABLE STRINGLESS TOP.

A primary object of my present invention is to provide a spinable object on a length-adjustable tether detachably secured to a rotatable bobbin whereby the distance between the bobbin and the object can be increased and decreased at will.

Another important object of the invention is to provide an amusement device of the indicated nature which is additionally characterized by the incorporation therein of means preventing the fouling of the tether during use of the device.

A still further object of my invention is to provide an improved amusement device of the aforementioned character which includes means for establishing and maintenance of a dynamic and static balance between the rotatable bobbin and the tethered spinable object.

Another object of the invention is to provide a combination of the indicated nature which enables the facile substitution of different spinable objects as well as the addition of attractive attachments thereto in order to enhance the utility as well as the versatility of varied types of the device enjoyable to an operator thereof.

Other objects of the invention together with some of the advantageous features thereof, will appear from the following description of an embodiment of the invention which is illustrated in the accompanying drawings and which is an exemplification of the best mode of construction thereof and manner of use of the invention. It is to be understood that the claims appended hereto are intended to cover not only the embodiment illustrated but also to variations thereof within the scope and purview of the invention.

Referring to the drawings.

Figures 1, 2, 3, 4, 5, 6:
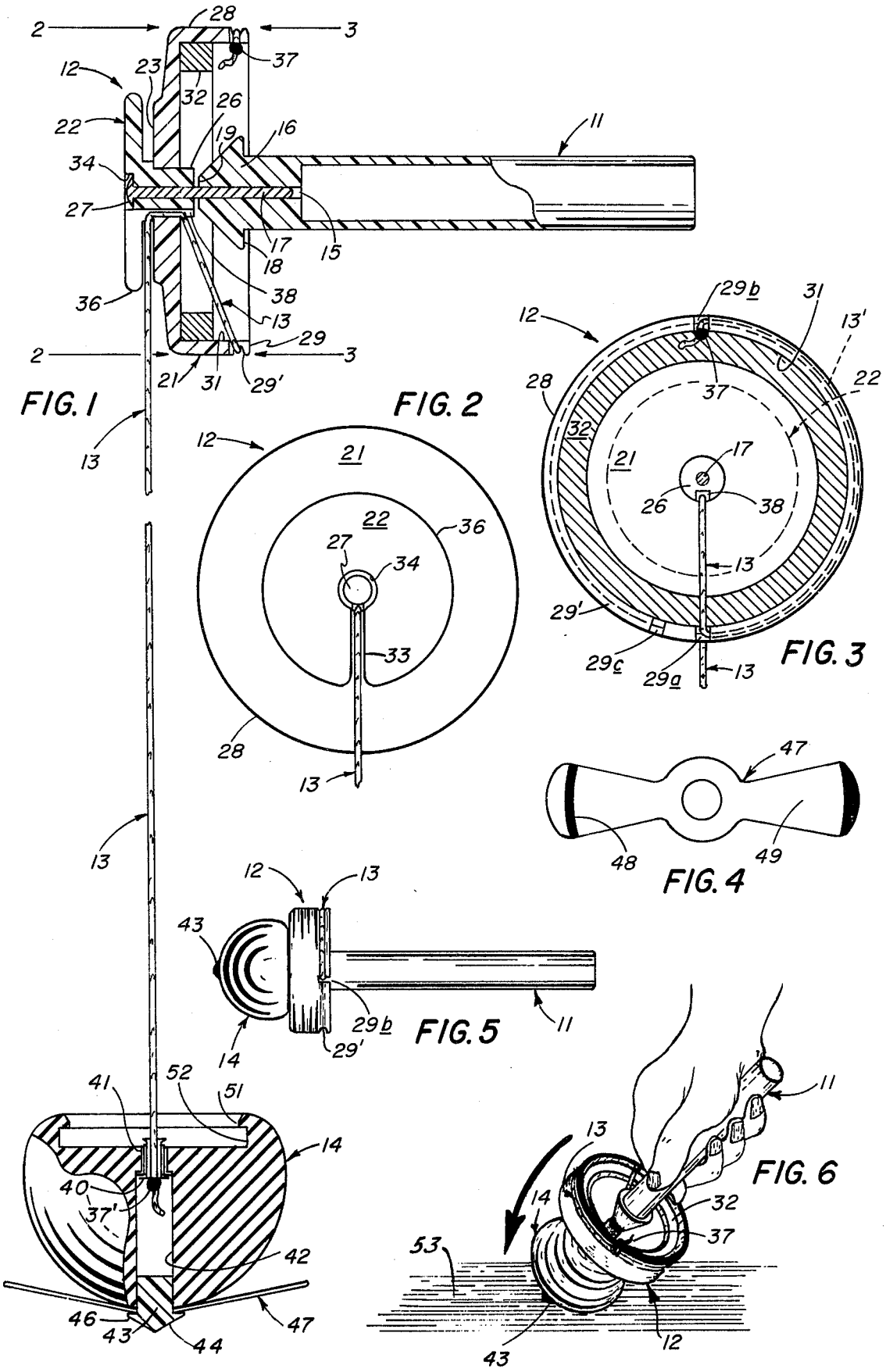
FIG. 1 is a sectional elevational view of a preferred embodiment of the present improvement, this view showing the tether in broken elevation and the manipulating handle partly broken away to illustrate the bobbin mounting components as well as the handle construction to prevent fouling of the tether.
FIG. 2 is an elevational view looking into the outer flange of the bobbin component; this view showing the outer end of the spindle on which the bobbin is mounted and portions of the tether, and being taken on the line 2—2 of FIG. 1.
FIG. 3 is an elevational view looking into the inner flange of the bobbin component, this view omitting the manipulating handle and showing the variable manner of detachably securing the tether to the bobbin, and being taken on the line 3—3 of FIG. 1.
FIG. 4 is a plan view of a design attachment for removable mounting on the bottom of the tethered spinable object which is shown in operative position in FIG. 1 as an attachment to the spinable object with the aid of the spinning top element.
FIG. 5 is a side elevational view of the assembled toy with the spinable object or bauble snapped onto the outer flange of the bobbin.
FIG. 6 is a diminutive perspective view of the preferred embodiment of the present improvement illustrated in the assembled view of FIG. 5; this view showing the hand of a person holding the bauble or object as a friction roller in engagement with a surface to effect the starting of the spinning of the toy.

In its best mode of construction a preferred embodiment of my present invention preferably comprises, in combination, a spinable object having a central narrow passage merging into a wide passage opening to the top as well as to the bottom thereof, an inner shoulder at the juncture of said narrow and wide passages, a pivot eyelet seated within said narrow passage with a bottom flange thereof abutting said inner shoulder, a length-adjustable tether extending into said narrow passage; said tether having a knot on one end thereof and a knot on the other end thereof with said one knot engaging said inner shoulder to retain said object on said tether, a spinning tip removably seated in the bottom of said wide passage, a design attachment removably mounted on said object for retention between the bottom thereof and said spinning tip, together with a handle, a bobbin rotatably mounted on said handle; said bobbin including an outer flange, a central mounting hub on said outer flange having a channel therein for passing the tether, and also including an inner flange having a grooved annular rim thereon defining an annular recess and fashioned with a plurality of spaced apart slits therein for seating and passing said tether with said knot at said other end thereof engaging the inner side of said inner flange at selected slits for adjusting the length of said tether, and an annular weight inertia body seated in said annular recess of said inner flange of said bobbin.

As illustrated particularly in FIG. 1 of the annexed drawings, my present improvement comprises four principal members including a manipulatable handle 11, a bobbin 12, a tether 13 and a spinable object 14 which may be caused to rotate rapidly in space, or may be caused to spin on a hard surface on its spinning tip. The handle may be fabricated from wood, a lightweight metal, or can be molded from a plastic material, as shown, and is so fashioned as to provide therein a centrally located passage 15 extending through a tapered inner extremity 16 of the handle for receiving a press-fitted spindle 17 upon which the bobbin 12 is mounted for relative rotational movement with respect to the handle.

In accordance with the invention, the bobbin 12 is specially constructed from a plastic substance primarily, in this instance, for providing an assembly and construction which enables the ready and easy adjustment of the length of the tether 13 and thereby making the toy playable and enjoyable for youngsters and people generally having different lengths of arms, such as boys and girls ranging between 6 and 9 years of age, for example, who would appreciate a cord length which is shorter than that enjoyed by boys and girls ranging in age between 9 and 14 with longer arms, and even longer tethers appreciated by taller boys and girls ranging in age between 14 and 18; all of which adjustments in length of the tether being readily made by even the unskilled. This specially constructed bobbin and manipulatable handle combination additionally insures against the fouling of the cord during play and thereby avoids frustrations arising from a tether being snapped or broken or fouled to the extent of being so entangled as to be unmanageable requiring it to be cut or thrown away. It will be observed, in this connection, that I have so constructed the handle at its tapered inner extremity 16 that the pitch of the taper is approximately at a 45° angle with respect to the longitudinal axis of the handle. During play, should the tether accidentally become wound about the handle 11, the feature of the tapered flange with its flattened rear face, as indicated at 18, prevents the bunching up or fouling of the tether ahead of the flat inner face 19 of the flange. It may be further noted that the 45° tapered flange 16 aids in initially feeding the tether 13 into operative position on the bobbin 12 by passing the same through the grooved hub of the outer flange thereof to cause the tether to be guided and rise up the incline of the tapered flange 16 of the handle, and then wound around the grooved rim section of the inner flange, inserted into a slit of such rim section, and knotted to anchor the same.

As particularly shown in sectional elevation in FIG. 1 of the drawings, the bobbin 12 comprises separate but connectable units consisting of a large inner flange 21 and a smaller outer flange 22 which are both molded from a suitable plastic material such as a phenol or an urea condensate, or molded as an integral unit, if desired. As shown, the inner flange 21 is formed with a flat outer face 23 having a centrally located opening therein for passing the combined hub and bearing unit 26 of the outer flange 22 through which the spindle 17 passes and on which the bobbin is rotatably mounted with the cap 27 of the spindle engaging the hub 26 of such outer flange 22. The face 23 of inner flange 21 merges with an annular rim 28 which, in turn, merges with an annular rim section 29 having an annular groove 29' therein for passing the tether 13 preliminarily to introducing the extremity of the tether through a selected one of a plurality of irregularly spaced apart slits **29*a*, 29*b* or 29*c* in the rim 28 of inner flange 21 of the bobbin. It is to be observed that the rim 28 defines an inner annular recess 31 in which any one of a plurality of members or inertia rings 32 of different weights is removably seated; it being understood that the inertia ring employed in the bobbin depends upon the proportionate weight of the particular object 14 that is tethered to the bobbin. In setting the tether initially, the specially constructed outer flange 22 of the bobbin is so fashioned as to provide a radial slot 33 leading to a central opening 34 and extending to and through the periphery 36** of the flange thus furnishing a path for the tether to follow when placing the tether in operative position.

With further reference to the construction of the bobbin 12, I provide means therein for permitting the easy feeding of the tether 13 into position for use by persons of all ages and so as to retain the tether on the bobbin by a simple knot 37 at said other end of the tether with the knot engaging against the inside of the rim section 29 after feeding through the groove 29' thereof and through one of the slits **29*a*, 29*b*, or 29*c*. This easy feeding, of course, applies not only to the initial cord 13 but also to all replacements thereof. The outer flange 22 is so fashioned as to provide passage 38 in its combined hub and bearing unit 26 for passing the tether 13 from outside into the inner flange 21 and to the area of the rim 28 and through the groove 29' of the rim section 29 before anchoring the knot 37 on the inside of a slit. With reference to FIG. 3, it will be observed that the tether 13 can be lengthened or shortened, as desired, by winding the tether about the peripheral groove 29' of the annular rim section 29, as indicated by the short dash lines 13' in FIG. 3, and then inserting the extremity of the tether through a selected slit and anchored. Of course, the tether may be wound once, twice or three times around the periphery 29'** depending how short one desires the tether to be or not wound at all about such periphery if a long tether is desired for taller people playing with the toy.

While the tethered object 14 can take any configuration desired, such as either of the shapes or forms illustrated in the drawings of my prior United States Letters Patent hereinabove mentioned, the object 14 of my present improvements is embodied in a flattened sphere which preferably is molded from rubber or other soft, resilient material, and is retained on the tether 13 by a knot 37' at said one end of said tether for engaging the inner flange of a pivot eyelet 40 seated in a narrow passage 41 formed in the top center of the object 14, and opening to the top thereof for passing the tether. As shown, the narrow passage 41 merges with a wider passage or cavity 42 which removably receives a metal or plastic spinning tip 43 fashioned to a cylindrical body portion fitting the cylindrical cavity 42 and with a tapered extremity 44 on which the object 14 may be caused to spin, when desired. It is to be observed that the spinning tip 43 is formed with a laterally extending flange 46 which serves as a seat for an attachment design 47 but also as an abutment to limit the inward movement of the spinner tip into the cavity 42 of object 14 upon mounting of the attachment design 47 thereon; such an attachment design in this instance being in the shape of an aeroplane propeller delineated in contrasting colors such as black and white as shown in FIG. 4.

In addition to causing the object 14 to move upwardly and downwardly on the tether 13 with great velocity and to rotate with great speed around its vertical axis, all by manipulation of the handle 11, as well as to be moved with varying speeds through various orbital paths at random but under the control of the player, the object 14 can be caused to spin on spinning tip 43 with its tapered extremity 44 in engagement with level surface. Reference, in this connection, is made to my Letters Patent of the U.S. Pat. No. 3,834,069 of Sept. 10, 1974 where in the fact is noted that in playing with the toy it is essential to keep tension on the cord or tether 13 in order to be in constant control of the object and its orbit or revolution. Skilled players can maneuver the centrifugal action of the object 14 so as to cause the object to move in either direction of rotation, or bring the object to an at rest or sleep position while the bobbin is spinning rapidly, and because of the use of a weighted member 32 in the bobbin which is proportionate to the weight of any given object suspended on the tether, smooth movements of the object in the different orbits are readily attained.

With respect to spinning the object on a level surface with the tapered end 44 of the spinning tip 43 engaging the surface, it is to be noted that I provide a resilient bead 51 on the top of the object 14 which defines a relatively large opening 52 in the top thereof for receiving the periphery 36 of the outer flange 22 of the bobbin when the object is snapped onto such outer flange 22, see FIGS. 5 and 6. With the toy assembled as shown in FIG. 5, the cord or tether 13 is wound upon the bobbin between the confronting surfaces of the inner flange 21 and the outer flange 22, with the object 14 snapped onto the center flange, not shown in this view. To initiate a spinning action, the handle 11 is grasped and the spinning tip 43 on object 14 is placed in engagement with the floor 53, or other level surface and rolled thereon rapidly or briskly and then released after bringing the handle 11 to a vertical position. Reference in this connection is made to FIG. 5 of my above mentioned U.S. Pat. No. 3,523,386. This effects the rotation of the entire toy, including handle 11 on its tapered tip 44 of the spinning tip 43, due to the impetus given by the rolling action, as aforesaid.

The advantateous features of the present invention makes the toy increasingly enjoyable to an ever increasing number of persons since the tether can be adjusted again and again to accommodate different lengths of arms of the persons desiring to play with the toy by increasing and decreasing the number of turns of the cord about the bobbin to be changed at will. The feature of the enlarged tapering flange on the inner end of the handle eliminates the fouling of the tether forward of such flange and concomittantly all frustrations resulting from fouled cords. There is also the added feature of providing a multiplicity of various color design attachments which can easily be removably mounted on the object.

The appended claims are intended to cover not only the embodiment illustrated in the accompaning drawings but also variations thereof within the scope and purview of the invention.

I claim:

1. In a flight controlled toy including a manipulatable handle, a bobbin rotatably mounted on said handle, a spinnable object, and a tether secured by a first knot at one end thereof to said bobbin and by a second knot at its other end to said object for enabling orbital movement thereof in relation to said handle and rotational movement thereof on a level surface, means for adujsting the length of said tether to vary the distance beetween said object and said bobbin to accommodate for different lengths of arms of persons playing with the toy, said means comprising a rearwardly projecting annular rim section on said bobbin having a recessed periphery thereon about which a portion of said tether is windable and retainable and also having a plurality of slits therein arranged at unequal distances apart on said periphery for selectively passing the adjacent portion of the extremty of said tether with said first knot engaged with the inner wall of said annular rim section thereby variably anchoring said tether to said bobbin.

2. In a flight controlled toy as set forth in claim 1, and a rearwardly and upwardly inclined flange on the inner end of said handle having a greater cross-section than the cross-section of said handle thereby preventing the fouling of said tether within said bobbin forwardly of said flange.

3. In a flight controlled toy as set forth in claim 1, and a tapered tip removably mounted in the bottom of said object on which the toy is spinnable in response to the rotation of said tether.

4. In a flight controlled toy as set forth in claim 1, and an attachment design removably and rotatably retained on said object between said tapered and the bottom of said object.

5. In a flight controlled toy as set forth in claim 1, and means for removably mounting said object onto said bobbin for retention thereon as a friction roller rotatable by the application of an external force thereto while in engagement with a level surface, and a removably spinning tip on the bottom of said object.

* * * * *